US005138855A

United States Patent [19]

Faris

[11] Patent Number: 5,138,855

[45] Date of Patent: Aug. 18, 1992

[54] PRESS-CONNECTED LOOP

[76] Inventor: Dale Faris, P.O. Box 17397, San Diego, Calif. 92177

[21] Appl. No.: 702,418

[22] Filed: May 20, 1991

[51] Int. Cl.[5] ..... A44B 15/00; A47G 29/10

[52] U.S. Cl. ..... 70/457; 24/674; 411/353; 63/1.1; 403/326

[58] Field of Search ..... 24/671, 673, 674; 70/457, 456 R, 459; 411/353, 517; 63/10, 3, 4, 1.1; 279/1 Q; 292/322-324; 403/326

[56] References Cited

U.S. PATENT DOCUMENTS

| | | | |
|---|---|---|---|
| 786,183 | 3/1905 | Bend | 24/673 |
| 1,774,347 | 8/1930 | Bainton | 411/517 X |
| 2,771,768 | 11/1956 | Tudor | 70/457 |
| 4,014,622 | 3/1977 | Lotz | 279/1 Q |
| 4,128,356 | 12/1978 | Carlisle | 70/457 X |
| 4,246,679 | 1/1981 | Monett | 24/671 |
| 4,543,695 | 10/1985 | Dorsey | 24/671 |

FOREIGN PATENT DOCUMENTS

| | | | |
|---|---|---|---|
| 125238 | 8/1947 | Australia | 24/673 |
| 361879 | 12/1938 | Italy | 411/517 |

*Primary Examiner*—Renee S. Luebke
*Assistant Examiner*—Darnell M. Boucher

[57] ABSTRACT

The loop comprises a flexible length of small-diameter cable, nylon or like tough, flexible material, which has on its respective ends a socket with a constricted area, and a plug with a reduced neck groove so that the plug is forcibly inserted into the socket to form a releasable but positive engagement between the two ends of the loop.

1 Claim, 1 Drawing Sheet

PRESS-CONNECTED LOOP

BACKGROUND OF THE INVENTION

The invention is in the field of key rings, key chains and other small loop-like members having releasable connecting ends. The inventor invented the TWIST LOCK ( TM ) key ring having ends that are twisted at an angle relative to one another before they can be connected or released. The inventor still manufactures and sells the twist lock rings as one of the Lucky Line product line.

Although the twist lock key ring is a great success, it has its limitations when it is applied to large rings on the order of three to six inches and even larger. Rings this large will naturally twist and turn without any conscious action on the owner in some circumstances, causing them to open accidentally.

It is one of the intents of the instant invention to produce a key ring that has the same holding power for the same connector regardless of the size of the ring, bearing in mind that the invention can be made with any degree of resistance to opening, and would in most cases be produced at the hard-to-open end of the spectrum for large key rings.

The above discussion applies as well to notebooks. The almost inevitable misalignment of the two halves that comprise a rigid notebook ring with time has caused the twist lock key chain construction to be used in making notebook rings, especially in the Military. The same limitation applies to these rings that applies to key rings, that is, large diameter rings will unintentionally separate.

SUMMARY OF THE INVENTION

The instant invention solves the above-stated problem by the use of a ring having mating ends which are pushed one into the other to force them together, and when together, have a positive resistance to separation. The two end ferrules are preferably made of brass, but could be made of many different materials. One ferrule is a plug member which inserts into the open end of a socket member, with an internal ring being mounted into the socket which snaps into an external groove of the plug member to hold the two together after the expanded tip of the plug end is forced through the constricting ring. Actually, either the plug or the ring could be made resilient, but this discussion is restricted to a resilient ring for simplicity.

DETAILED DESCRIPTION OF THE PREFERRED EMBODIMENTS

Figure 1:
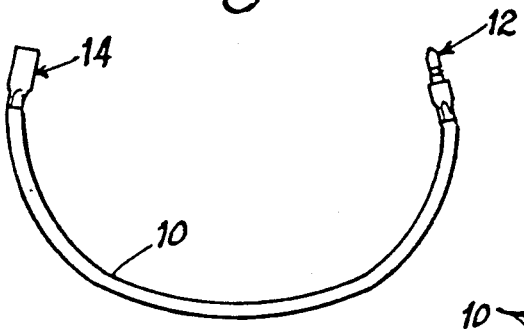
FIG. 1 is a side elevation view of a typical ring.

FIG. 1 illustrates the overall appearance of the invention, having a flexible loop 10 with male and female ferrules 12 and 14, respectively. The ferrules are made of brass in the preferred embodiment, and are crimped onto the ends of the loop 10. The ring member would generally be a non-compressible material such as Nylon ( TM ) or stainless steel cable. Although other methods of attachment of the ferrules would be possible, crimping is the simplest, generally the cheapest, and produces a very strong connection.

Figure 4:
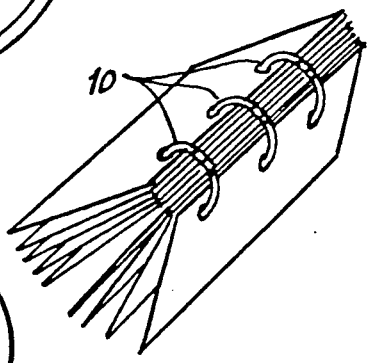
FIG. 4 is illustrates the use of three rings as a three-ring binder.
Figure 3:
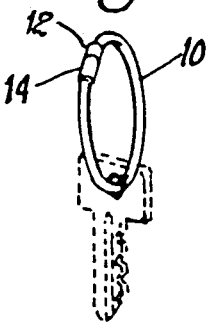
FIG. 3 is illustrates the ring used as a key ring.
Figure 2:
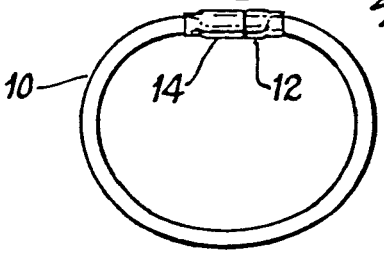
FIG. 2 is a an elevation view similar to FIG. 1 but the two end ferrules are joined together.
Figure 5:
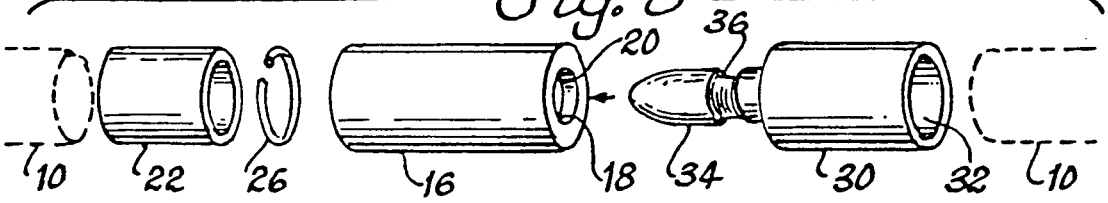
FIG. 5 is an exploded perspective illustrating the construction and mating alignment of the two ferrules.
Figure 6:
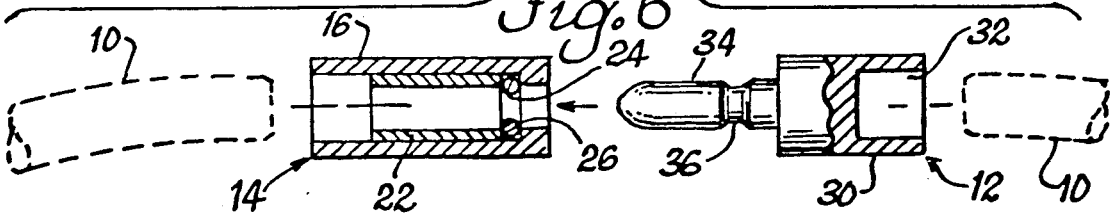
FIG. 6 is a side elevation view largely in section of the two ferrules illustrating the flexible ring portion in phantom.

The unit is shown in its connected mode in FIG. 2, and illustrated in a diagrammatic fashion as it would be used as a key ring in FIG. 3, and as the rings of a binder in FIG. 4. One advantage of this construction is that it is practical irrespective of the diameter of the rings, within reason. Very large rings on the order of six inches in diameter are quite practical, whereas similar rigid rings would not be, and the twist lock type rings would work but are less practical than the rings illustrated.

Figure 7:
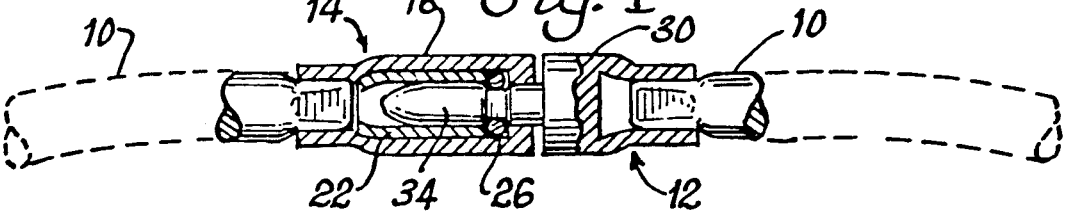
FIG. 7 is a view substantially identical to FIG. 6 but showing the flexible ring portions attached and the ferrules mated.
Figure 8:
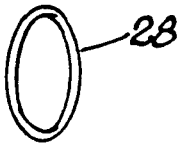
FIG. 8 illustrates a modified form of the ring inside the socket in which it is not split, but is adequately resilient not to require a split.

FIGS. 5 through 8 illustrate the details of construction of the ring. The female ferrule is comprised of an outer sleeve 16 which has an inwardly-directed shoulder 18 which defines an open end 20. Inside the ferrule is a second, inner sleeve 22 which is spaced from both ends of the outer sleeve 16, defining at the mating end the annular seat 24, and leaving ample space at the opposite end to crimp on the end of the flexible loop 10. Once assembled, the portion of the ferrule at the flexible loop end is crimped around both the end of the inner sleeve and the loop as shown in FIG. 7.

In the annular seat 24 there resides a constriction element, which could be a split ring 26 if the material is resilient but not flexible, such as brass, spring, steel or a tough elastomer, or it could be made as a continuous loop or O-ring 28.

The male ferrule 12 has a body portion 30 with an open area 32 for crimping around the end of the flexible loop 10, and a forwardly extended plug member having a tip element 34 having a reduced neck groove 36. The end of the ferrule is crimped onto the flexible loop and to join the members of course, the tip element 34 is pressed into the socket 16, expanding the constriction element 26 until the groove portion 36 aligns with the constricting ring, at which point it snaps into place into the groove to provide a positive restraint between the two ferrules.

Clearly, the strength of connection between the two ferrules can be varied at will, and ordinarily the detent strength would be generally proportional to the size of the ring, both in overall ring diameter, and the thickness of the flexible ring portion. It is clear that with this construction, there is no way to separate the ring without applying the threshold amount of force. In other words, twisting the rings as with a twist lock obviously will not open it, nor will angulating one ferrule relative to the other according to the way another cable-type ring functions. Although it is also suitable for small-sized key rings and the like, it is virtually ideal for some configurations of large notebook rings and key rings.

It is hereby claimed:

1. A fastener comprising:

(a) An elongated, bullet-shaped plug member having an expanded tip element with a reduced neck groove;

(b) A socket member having an open end with a constriction element spaced from said open end, said constriction element having an internal relaxed diameter slightly smaller than the outside relaxed diameter of the expanded tip element of said plug member;

(c) said constriction element being a constriction ring seated in an annular seat in said socket member such that said plug can be forcibly inserted into said socket, forcing said tip element through said constriction element until said constriction element snaps into a positive detente relationship with said groove;

(d) said socket comprising an outer cylindrical sleeve with an inwardly directed annular shoulder defining said open end, said annular seat being defined by an inner cylindrical sleeve inserted into said outer sleeve to a point spaced from said shoulder to define said annular seat between said inner sleeve and shoulder;

(e) said sleeves both being metallic and said outer sleeve being crimped onto said inner sleeve;

(f) said members have mating ends defining said open end and said expanded tip, respectively, and having ends opposite said mating ends; and, (g) a flexible loop, and said ends opposite said mating ends each being open and crimped around the ends of said flexible loop.

* * * * *